US005427533A

United States Patent [19]

Chambers

[11] Patent Number: 5,427,533

[45] Date of Patent: Jun. 27, 1995

[54] ZERO INSERTION FORCE CONNECTOR

[75] Inventor: Donald M. Chambers, Whittier, Calif.

[73] Assignee: Northrop Grumman Corporation, Los Angeles, Calif.

[21] Appl. No.: 146,856

[22] Filed: Nov. 2, 1993

[51] Int. Cl.[6] ..... H01R 9/09

[52] U.S. Cl. ..... 439/62; 439/493

[58] Field of Search ..... 439/62, 67, 77, 260, 439/492, 493, 495, 499, 637, 636, 632, 933

[56] References Cited

U.S. PATENT DOCUMENTS

| | | | |
|---|---|---|---|
| 3,614,707 | 10/1971 | Kaufmann et al. | 439/260 |
| 3,864,012 | 2/1975 | Cutchaw | 439/260 |
| 3,922,054 | 11/1975 | Dechelette | 439/260 |
| 3,980,376 | 9/1976 | Rosen | 439/260 |
| 4,221,448 | 9/1980 | Logerot et al. . | |
| 4,348,071 | 9/1982 | Hsieh | 439/67 |
| 4,533,189 | 8/1985 | Scoccia et al. | 439/260 |
| 4,815,979 | 3/1989 | Porter | 439/62 |
| 4,894,022 | 1/1990 | Guckenheimer | 439/260 |
| 4,904,197 | 2/1990 | Cabourne | 439/260 |
| 5,044,980 | 9/1991 | Krumme et al. | 439/496 |
| 5,080,595 | 1/1992 | Mouissie | 439/67 |
| 5,240,420 | 8/1993 | Roberto | 439/62 |

*Primary Examiner*—Larry L. Schwartz
*Assistant Examiner*—Hien D. Vu
*Attorney, Agent, or Firm*—Terry J. Anderson; Karl J. Hoch, Jr.

[57] ABSTRACT

An electrical connector for use in connecting one printed circuit board to another printed circuit board in which the electrical contacts of one board exert zero-force on the electrical contacts of the other board. The connector includes a housing of generally U-shaped configuration having a receptacle into which the contacts of one circuit board are inserted to make electrical contact with flexible contacts in the receptacle of the connector, the flexible contacts normally being farther apart than the entrance opening into the receptacle so that there is no force imposed on the contacts entering the receptacle. A spring driver in the receptacle forces the flexible contacts into firm electrical contact with the contacts entering the receptacle only after the latter has been fully inserted into the receptacle.

4 Claims, 2 Drawing Sheets

PRINTED CIRCUIT CARD
62
61
10
30
40
52
34
40'
40"
68
32
54
26
50
66
56
24
43
28
64
22
20
36

PRINTED CIRCUIT CARD
62
61
FLEX LAMINATE
24
52
FLEX LAMINATE ALIGNMENT PIN
64
22
68
SPRING DRIVER
66
56

PRINTED CIRCUIT CARD
62
61
24
40'
52
64
22
60
58
68
40"
66
56

ZERO INSERTION FORCE CONNECTOR

BACKGROUND OF THE INVENTION

The present invention relates generally to the field of electrical connectors, and more particularly to electrical connectors for interconnecting various types of printed circuit boards having a multiplicity of individual circuits thereon.

It has long been well known in various electronics applications, such as computers and other complex electronic equipment, to interconnect printed circuit boards which perform specific functions in the application, and which, from time to time, must be disconnected for various reasons. For example, it is often desirable to connect removable circuit boards, typically referred to as printed circuit cards or daughter boards, which include electronic components and appropriate circuitry for performing a specific function, to a mother board in a particular electronics application. Such an arrangement greatly facilitates the replacement of various types of circuit modules within the mainframe of the application, either for modification of the mainframe function or repair or replacement of defective circuit modules.

In this environment, it is not uncommon for a particular daughter board to have a large number of terminals that must be connected to a corresponding number of terminals on the mother board. In the past, the connection of individual circuits between the boards was accomplished by providing one of the boards, usually the daughter board, with a plurality of pins, one for each circuit, and by providing the mother board with an equal number of recesses or holes into which the pins were inserted during connection of the boards. This arrangement was satisfactory with installations in which the boards were intended to be connected relatively permanently, or at least where they were to be disconnected very infrequently.

However, this arrangement was not satisfactory in installations in which the daughter boards were changed or replaced with some degree of frequency, as in the case of a generic motherboard with custom daughter boards having a specific mission profile. With a multiple pin connection, a certain minimum amount of force between the pin and a contact within the receptacle into which the pin is inserted is required to maintain engagement and to assure that good electrical contact is maintained at all times.

The problem that develops is that during insertion and removal of the boards, the force that is established between the pins and the receptacle contacts eventually causes deleterious wear on the pins and the contact surfaces, resulting in poor electrical contact from uneven mating of pin and contact surfaces. Also, the rubbing contact between the pin and contact surfaces during insertion and removal of the pins tends to promote the accumulation of dirt and/or coatings which adversely affect electrical contact.

Another significant disadvantage of multiple pin connectors is that the force necessary to cause the insertion of the pins into the receptacles can render the physical connection difficult to accomplish and can damage the pins. It will be appreciated that, while the force required to connect or disconnect one pin into or from one receptacle may be relatively small, for connectors having a hundred or more pins, the force becomes quite considerable. For example, standard mother board/daughter board connectors have an individual mating force of from 2.5 to 4 ounces per pin; this equates to 15 to 25 pounds of force required per hundred pins, for both connecting and disconnecting. Since some high density computer modules today have as many as 250 to 300 pins, it will be apparent that very considerable force may be required to make a particular connection, and further that the force required for disconnection may be so great as to require a tool to effect the disconnection of two boards, with the attendant risk of bending pins or otherwise damaging one of the boards.

A major solution to the foregoing problem has been the advent of zero-force connectors, of which several have been developed and can be found in the art. The salient feature of the zero-force connector is that, whatever the form of the electrical contact elements on the respective boards being connected, there is no force applied therebetween during the actual connecting and disconnecting movements of the respective boards. Unfortunately, prior art zero-force electrical connectors that have been developed and are commercially available, all have certain deficiencies and disadvantages that render them unsatisfactory in most electronic mother board/daughter board applications. Many are not actually zero-force connectors, but rather are reduced force connectors, in which the sliding contact force between contacts on either board, encountered during connection and disconnection of the boards, is reduced to a lower level than that which is established after full connection is made and which is maintained until the boards are disconnected. Other connectors, which are truly zero-force, are very complicated and costly, a factor which takes on major economic proportions in view of the vast quantities of boards utilized in modern day computer manufacturing. Some require the use of tools to generate sufficient force after connection to provide good physical connection and electrical contact, thereby perhaps preventing the insertion and removal of daughter board cards by users of the equipment, and even making the insertion and removal difficult for service personnel. In addition, most prior art zero-force connectors are for individual circuits without providing electrical shielding or impedance control.

Thus, there is a need for a simple, inexpensive, yet highly efficient and effective zero-force electrical connector for use in connecting printed circuit card modules to mother boards in sophisticated electronic applications.

SUMMARY OF THE INVENTION

The present invention is intended to at least obviate, if not eliminate, the disadvantages and shortcomings of prior art zero-force electrical connectors used with printed circuit boards. The electrical connector of the present invention accomplishes this objective by providing a device which is structurally very simple, comprising only three parts, and therefore relatively inexpensive, and which is truly zero-force during the installation and removal of a daughter board from a mother board. The connector requires no tools for establishing sufficient force to maintain good physical connection and electrical contact after installation of a daughter board. Also, by having quick-change capabilities, an equipment designer can customize a unit to meet individual customer requirements without the added cost of modifying all other systems. In addition, the connector of the present invention is designed to shield each signal, on all sides, through the entire connector while also providing a controlled impedance electrical path.

The electrical connector of the present invention comprises, briefly, a housing having a generally U-shaped configuration, the housing having a bottom wall and a pair of opposed, spaced apart side walls connected to the bottom wall and defining a receptacle therebetween and with said bottom wall, the side walls terminating upwardly in guide portions extending toward each other to define an entrance opening into the receptacle. There are suitable means on the lower wall of the housing for connecting the housing to a mother board. A flexible laminate electrical contact member extends around the housing from the lower surface of the bottom wall and into the receptacle to a position adjacent the upper surface of the bottom wall, thereby defining a U-shaped portion of the flexible contact member within the receptacle. A spring driver means is located in the receptacle, the spring driver means having a generally U-shaped configuration defined by a pair of opposed, spaced apart upstanding legs connected to a cross member supported by the bottom wall of the housing beneath the U-shaped portion of the flexible laminate contact member, the upstanding legs being normally spaced apart a distance wider than the entrance opening into the receptacle. The cross member includes means for causing the upstanding legs to move toward each other in response to downward pressure exerted on the cross member by insertion of a contact member mounted on a daughter board. With this construction, the upstanding legs move toward the daughter board contact member during the final small increment of downward movement of the daughter board contact member to press the flexible contact member against the daughter board contact member when the latter reaches its lowermost position in the receptacle.

In some of the more limited aspects of the invention, the upstanding legs are provided with pressure points at an intermediate location therealong but which are spaced farther apart than the width of the entrance opening into the receptacle, thereby maintaining the intermediate portions of the legs out of contact with the daughter board contact member during insertion of the latter into the receptacle. In the preferred embodiment of the invention, the pressure points are defined by the upstanding legs being bowed inwardly between the junctures of the upstanding legs with the cross member and the upper ends of the upstanding legs. Further, the means for causing the upstanding legs to move toward each other comprises the cross member of the spring driver being bowed upwardly between the junctures of the cross member and the upstanding legs so that downward pressure on the upwardly bowed cross member causes the upstanding legs to flex inwardly. Further, the flexible laminate contact member is formed as a three layer laminate of alternating layers of copper foil and a polyimide film bonded together, and staggered portions of the flexible laminate are removed adjacent to the inwardly bowed portions of the upstanding legs so as to expose all of the layers of the copper foil in the laminate to the pressure points of the upstanding legs.

Having briefly described the general nature of the present invention, it is a principal object thereof to provide a zero-force electrical connector for connecting one printed circuit board to another printed circuit board which avoids the disadvantages and shortcomings of prior art zero-force electrical connectors, yet retains the salient advantageous feature of exerting zero-force on electrical contact points during insertion and removal of circuit boards from the connector.

Another object of the present invention is to provide a zero-force electrical connector for the purpose disclosed which is extremely simple in construction yet efficient and effective in operation, thereby rendering the connector very inexpensive and easy to use with removable circuit board modules.

Another object of the present invention is to provide a zero-force electrical connector in which the individual conductors of the flexible laminate contact member are shielded on all sides.

Other objects, advantages and features of the present invention will become apparent from an understanding of the following detailed description of a presently preferred embodiment of the invention when considered in conjunction with the accompanying drawings.

DETAILED DESCRIPTION OF THE INVENTION

Figure 1:
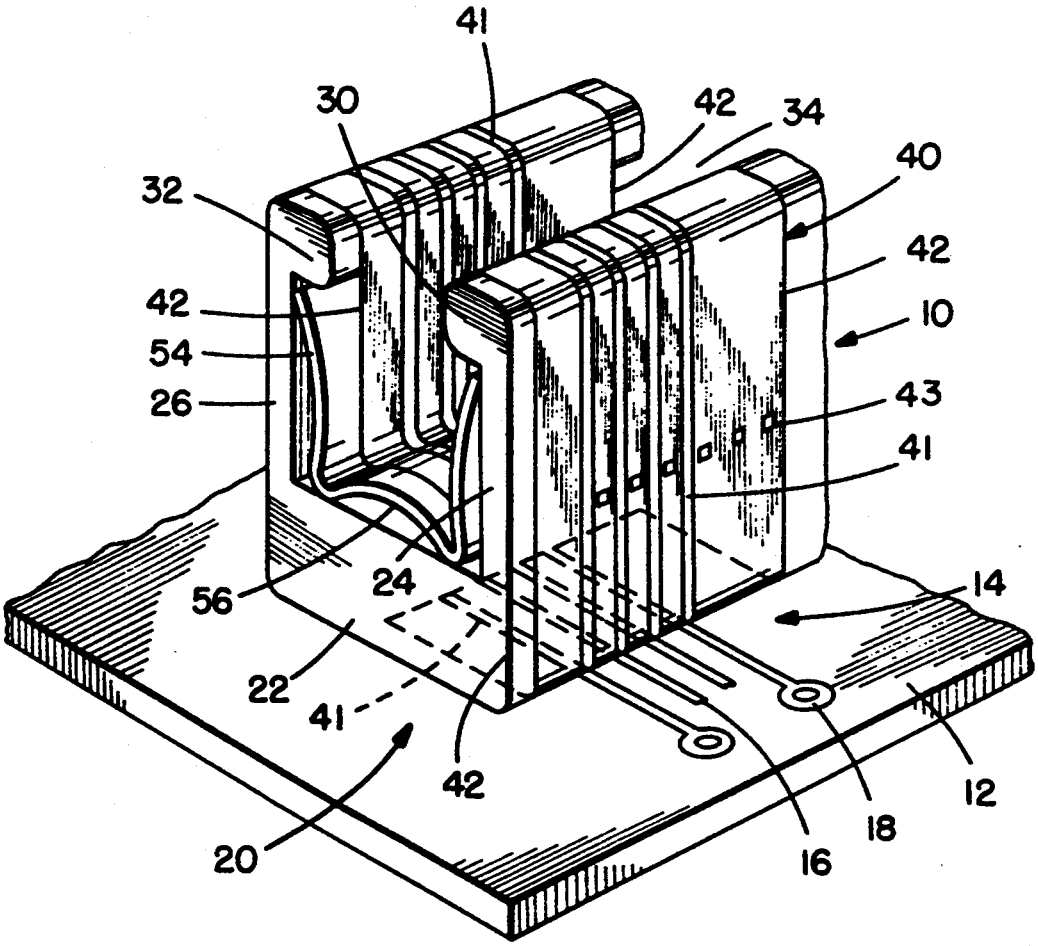
FIG. 1 is a perspective view of the electrical connector of the present invention shown connected to a mother board printed circuit board.

Referring now to the drawings, and particular to FIG. 1 thereof, the reference numeral 10 designates generally an electrical connector for use in connecting one printed circuit board to another and constructed in accordance with the principles of the present invention. The electrical connector 10 is shown mounted on a mother board 12, which is a typical printed circuit board having a plurality of circuit traces printed thereon and generally indicated by the numeral 14, which either extend to other parts of the mother board as indicated by the numeral 16 or terminate in wire connectors as indicated by the numeral 18.

Figures 2, 3, 4:
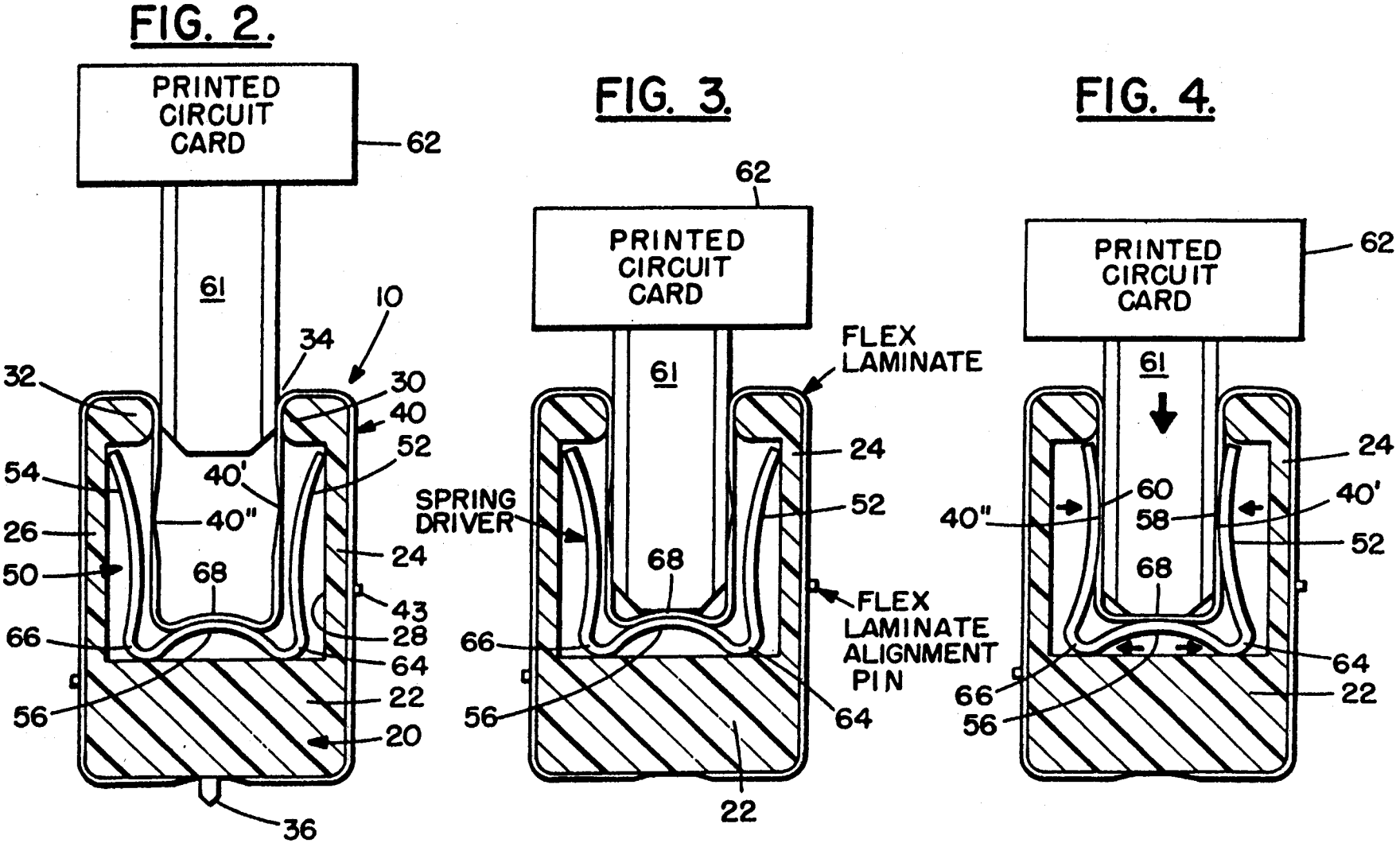
FIG. 2 is a sectional view through the electrical connector shown in FIG. 1 with the daughter board contact member just entering the entrance opening into the electrical connector receptacle.
FIG. 3 is a sectional view similar to FIG. 2 but showing the daughter board contact member inserted into the electrical connector receptacle far enough to just contact the upwardly bowed portion of the flexible electrical contact member within the receptacle.
FIG. 4 is a sectional view similar to FIGS. 2 and 3 but showing the daughter board contact member fully inserted into the electrical connector receptacle and the contact portions of the spring drive upstanding legs in contact with the side portions of the flexible electrical contact member.

With reference to FIGS. 1 and 2, the electrical connector 10 is seen to comprise a housing, generally indicated by the reference numeral 20, which is generally of U-shaped configuration. The housing 20 has a bottom wall 22 and a pair of opposed, spaced apart side walls 24 and 26 which, together with the bottom wall 22, define a receptacle 28. The side walls 24 and 26 terminate upwardly in guide portions 30 and 32 which extend toward each partially over the receptacle 28 to define an entrance opening 34 into the receptacle 28.

Any suitable means, such as a screw 36 or a rivet connected to the under surface of the bottom wall 22, may be provided to secure the electrical connector 10 to the mother board 12.

Figure 5:
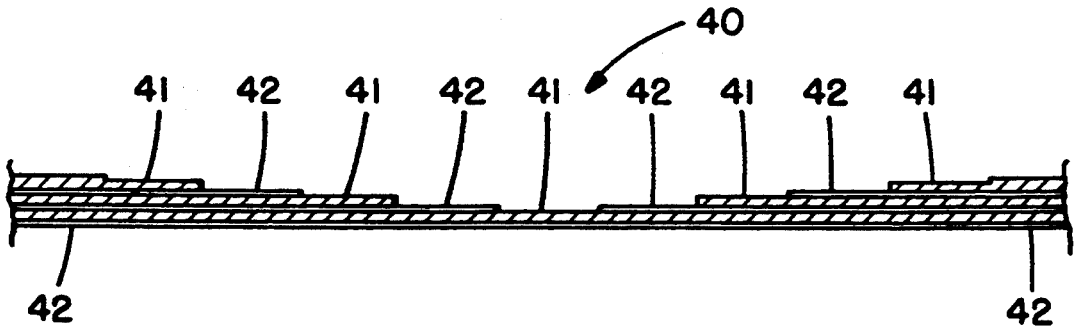
FIG. 5 is a sectional view, drawn to a greatly enlarged scale, of a portion of a flexible laminate electrical contact member, showing the three layer construction of the laminate.

In the preferred embodiment, a flexible laminate electrical contact member, designated generally by the reference numeral 40, is mounted on the connector 10. The flexible laminate contact member 40 is made up of a plurality of flexible electrical contact members 41, which are strips of copper foil suitably bonded to an electrically insulating polyimide film 42 in a manner known in the art. The width of the film 42 and the number of individual contact members 41 can vary to meet the contact needs of individual situations. To create a shielded flexible laminate 40, several layers of copper foil 41 and insulating film 42 are bonded together in alternate layers to form a multiple layered laminate, as seen in FIG. 5. Due to the stiffness of this laminated stack, the practical maximum number of layers for a flexible laminate 40 is three.

As best seen in FIG. 2, the flexible laminate 40 extends around the housing 20 from the lower surface of the bottom wall 22, up the outer surface of the side walls 24 and 26 and into the receptacle 28 to a position adjacent the upper surface of the bottom wall 22, thereby defining a U-shaped portion of the flexible laminate within the receptacle 28. Individual flexible contact members 41 are not adhered to the housing 20, but rather the entire flexible laminate contact member 40 is secured to the outside of the housing 20 by being glued to the surface thereof. A plurality of alignment pins 43 suitably secured to the outer surfaces of the walls 24 and 26 cooperate with apertures performed in the flexible laminate 40 to maintain the flexible laminate 40 in proper alignment on the housing 20. The portion of the flexible laminate 40 that extends along the lower surface of the bottom wall 22 of the housing 20, as indicated by the dotted lines in FIG. 1, is adapted to contact the printed circuit traces 16 and 18 formed on the mother board 12 when the electrical connector 10 is properly secured to the upper surface of the mother board.

Still referring to FIG. 2, it will be seen that the flexible laminate 40 is provided with two sections 40' and 40" which appear thinner in cross section than the rest of the flexible laminate. These two sections, which are shown in greatly enlarged scale in FIG. 5, serve as windows in the flexible laminate 40 to allow an-electrical contact member, further described below, to make contact with all of the layers of the contact members 41 making up the three layer laminate 40 described above. It will be seen from FIG. 5 that the three layer laminate 40 is made up of alternate layers of copper foil 41 and layers of polyimide film 42. In order to ensure good electrical contact between a contact member described below and the three layers of laminate 40, staggered portions of the outer layers of copper foil 41 and polyimide film 42 are removed in sequential steps to exposed remaining portions of the copper foil 41.

Still referring to FIG. 2, the electrical connector 10 is provided with a spring driver means, generally indicated by the reference numeral 50, located within the receptacle 28, the function of which is to make electrical contact between the flexible electrical contact members 40 and the contact members on the portion of the daughter board to be connected to the connector 10. The spring driver means 50 comprises a pair of opposed, spaced apart upstanding legs 52 and 54 which are connected at their lower ends to a cross member 56 which extends across the bottom wall 22 of the housing beneath the U-shaped portion of the flexible contact members 40, the normal configuration of the upstanding legs 52 and 54 being such that they are normally spaced apart a distance wider than the entrance opening 34 into the receptacle 28 as defined by the inwardly projecting guides 30. The upstanding legs 52 and 54 are provided with pressure points 58 and 60 (see FIG. 4) at an intermediate location along the upstanding legs which are spaced farther apart than the width of the entrance opening 34. Although the pressure points could comprise raised protuberances formed or mounted on the inner surface of the upstanding legs at the appropriate location, in the preferred embodiment of the invention the pressure points 58 and 60 are defined by inwardly bowed portions of the upstanding legs between the junctures 62 and 64 of the upstanding legs with the cross member 56 and the upper ends of the upstanding legs.

The cross member 56 includes means for causing the upstanding legs 52 and 54 to move inwardly toward each other in response to downward pressure exerted on the cross member 56 by insertion of a contact member 61 mounted on the daughter board 62. The daughter board 62 is a piece of insulating material, typically fiberglass or ceramic, on which circuits have been laminated and etched, and the contact member is simply an extension of the daughter board which carries the laminated and etched circuit into the connector 10. In the preferred embodiment of the invention, the cross member 56 is bowed upwardly from the junctures 64 and 66 of the cross member 56 and the upstanding legs 52 and 54. It will also be seen that the U-shaped portion of the flexible electrical contact members 40 have a lowermost portion 68 which rests on and conforms to the upwardly bowed shape of the cross member 56 when no downward force is being imposed on this portion of the flexible electrical contact member by the daughter board contact 61, as seen in FIG. 2.

The operation of the electrical connector 10 can best be understood from a description of the installation of a daughter board into the connector. FIG. 2 shows the position of the parts of the connector 10 just as the contact member 61 of the daughter board 62 enters the opening 34 into the receptacle 28, at which time there is no contact between the contact member 61 and the flexible contact members 40. With reference to FIG. 3, as the contact member 61 of the daughter board 62 is further inserted into the receptacle 28, the outer end of the contact member 61 comes into contact with the bottom portion 68 of the U-shaped loop of the flexible contact member 40, during which time there is still no contact between the daughter board contact member 61 and the flexible contact member 40, thereby providing zero-force insertion.

Further insertion of the contact member 61 depresses the upwardly bowed portion 68 of the flexible contact member 40 and the upwardly bowed cross member 56. As the cross member 56 is depressed downwardly, the junctures 64 and 66 between the cross member 56 and the upstanding legs 52 and 54 are moved laterally outwardly, and simultaneously an angular stress is set up in the junctures 64 and 66, counterclockwise in the former and clockwise in the latter, which tends to rotate the upstanding legs 52 and 54 in the corresponding angular directions, all as shown in FIG. 4. This causes the pressure points 58 and 60 to come into firm contact with the adjacent portions 40' and 40" of the flexible laminate contact member 40, as shown in FIG. 4, in which the staggered portions thereof have been removed, as seen in FIG. 5, thereby establishing firm electrical contact between all of the contact members 41 of the flexible laminate 40 and the daughter board contact 61. When the daughter board contact 61 is fully inserted into the connector 10, the forces applied by the pressure points on the upstanding legs 52 and 54 of the spring driver means are sufficient to provide an air tight seal between the flexible contact member 40 and the contact member 61. This air tight seal precludes the intrusion of contaminants, thereby reducing the effects of corrosion.

As long as the above condition prevails, the contact pressure between the flexible contact member 40 and the daughter board contact 61 will be maintained to ensure the gas tight, highly conductive joint between the flexible contact member 40 and the contact member 61. It should be noted that in reversing the above procedure to withdraw the daughter board contact 61 from the connector 10, as soon as the withdrawal movement of the contact 61 commences, the cross member 56 tends to resume its original upwardly bowed configuration, which in turn removes the stress from the junctures 64 and 66, thereby permitting the upstanding legs 52 and 54 to rotate back to their original positions and immediately remove all contact force between the flexible contact member 40 and the daughter board contact 61 during the remainder of the withdrawal movement of the contact member 61.

From the foregoing it should now be clearly apparent that there has been provided a truly zero-force electrical connector for connecting two printed circuit boards together. Although a presently preferred embodiment of the invention has been described and shown herein, it should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector for connecting a first printed circuit board to a second printed circuit board, comprising:

a housing having a generally U-shaped configuration, said housing comprising a bottom wall, a pair of opposed, spaced apart side walls connected to said bottom wall and defining a receptacle therebetween and with said bottom wall, said side walls terminating upwardly in guide portions extending toward each other to define an entrance opening into said receptacle, and a plurality of alignment pins secured to outer surfaces of said side walls;

means on a lower surface of said bottom wall for connecting said housing to said second printed circuit board;

a flexible laminate member secured to said housing and extending around said housing from said lower surface of said bottom wall, up said outer surfaces of said side walls and into said receptacle to a position adjacent an upper surface of said bottom wall, thereby defining a U-shaped portion of said flexible laminate member within said receptacle, said flexible laminate member comprising a plurality of electrically insulating film layers, a plurality of electrical contact layers bonded to said insulating film layers in alternating layers, each said electrical contact layer comprising strips of electrically conductive foil, and a plurality of alignment apertures cooperatively engaging respective ones of said alignment pins, whereby said flexible laminate member is maintained in proper alignment upon said housing, a portion of said flexible laminate member extending along said lower surface of said bottom wall being adapted for electrically contacting printed circuit traces of said second printed circuit board upon proper securement of said electrical connector to said second printed circuit board, said flexible laminate member having electrical contact portions at opposing locations on sides of said U-shaped portion of said flexible laminate member, each said electrical contact portion comprising staggered portions of said insulating film layers and said electrical contact layers wherein outer layer portions of said electrical contact layers and said insulating film layers are removed in sequential steps, whereby remaining portions of said electrical contact layers are exposed; and, spring driver means located within said receptacle for urging said electrical contact portions of said flexible laminate member into electrical contact with a contact member of said first printed circuit board, said spring driver means comprising a cross member having an upwardly bowed shape, said cross member extending across said bottom wall beneath said U-shaped portion of said flexible laminate member between points respectively adjacent to said side walls, and a pair of opposed, spaced apart upstanding legs connected at respective lower ends of said legs to said cross member at respective junctures, said junctures being supported on an upper surface of said bottom wall, said upstanding legs being normally spaced apart a distance wider than said entrance opening into said receptacle, a lowermost portion of said U-shaped portion of said flexible laminate member resting upon a top of said upwardly bowed shape of said cross member, said upstanding legs having opposing pressure points at respective intermediate locations of said upstanding legs for engagement with said electrical contact portions of said flexible laminate member, said junctures moving laterally apart each from the other in response to a downward pressure exerted on said lowermost portion of said flexible laminate member and on said cross member by insertion of said contact member into said U-shaped configuration of said housing, whereby angular stresses are formed in said junctures, said upstanding legs being rotated in first opposing directions each toward the other in response to said angular stresses, said pressure points engaging respective ones of said electrical contact portions in response to said rotation in said first opposing directions and pressing said electrical contact portions against said contact member in firm electrical contact therewith upon full insertion of said contact member into said U-shaped configuration of said housing, said pressing applying contact forces to said electrical contact portions and said contact member thereby retaining said first printed circuit board in said electrical connector while said contact member is inserted in said U-shaped configuration of said housing, said downward pressure being removed in response to a withdrawal of said contact member from said U-shaped configuration, said junctures moving laterally each toward the other in response to said removal of said downward pressure, whereby said angular stresses are removed from said junctures, said upstanding legs being rotated in second opposing directions each away from the other in response to said removal of said angular stresses, said pressure points disengaging from said respective ones of said electrical contact portions in response to said rotation in said second opposing directions and removing said contact forces from said electrical contact portions and said contact member, said insertion and said removal of said first printed circuit board into and from said electrical connector being thereby respectively accomplished in an absence of said contact forces.

2. The electrical connector as set forth in claim 1 wherein said pressure points comprise inwardly bowed portions of said upstanding legs respectively extending between said junctures and respective upper ends of said upstanding legs.

3. The electrical connector as set forth in claim 1, wherein said contact forces form said flexible laminate member into a seal between said contact member and said electrical connector while said contact member is inserted in said U-shaped configuration of said housing.

4. The electrical connector as set forth in claim 1 wherein said pressure points comprise protuberances respectively formed on said upstanding legs at said respective opposing intermediate locations.

* * * * *